US005370959A

United States Patent [19]

Hagiwara et al.

[11] Patent Number: 5,370,959

[45] Date of Patent: Dec. 6, 1994

[54] IMAGE FORMATION METHOD

[75] Inventors: Tomoe Hagiwara, Fuji; Shinichi Kuramoto; Motoi Orihara, both of Numazu, all of Japan

[73] Assignee: Ricoh Company, Ltd., Tokyo, Japan

[21] Appl. No.: 855,577

[22] Filed: Mar. 23, 1992

[30] Foreign Application Priority Data

Mar. 22, 1991 [JP] Japan ..... 3-083470

[51] Int. Cl.[5] ..... G03G 13/08

[52] U.S. Cl. ..... 430/120; 430/110

[58] Field of Search ..... 430/106.6, 106, 45, 430/120, 122, 110; 118/657, 651

[56] References Cited

U.S. PATENT DOCUMENTS

| | | | |
|---|---|---|---|
| 4,576,463 | 3/1986 | Sakamoto et al. | 118/657 |
| 4,866,480 | 9/1989 | Hosoya et al. | 118/651 |
| 4,876,573 | 10/1989 | Kamimura | 430/120 |
| 5,096,798 | 3/1992 | Kanbe et al. | 430/122 |

*Primary Examiner*—John Goodrow
*Attorney, Agent, or Firm*—Cooper & Dunham

[57] ABSTRACT

An image formation method of developing a latent electrostatic image formed on a latent-electrostatic-image bearing member to a visible toner image by a one-component type developer consisting essentially of a toner is carried out by the steps of forming numerous micro closed electric fields near the surface of a developer-bearing member by causing the developer-bearing member to selectively hold electric charges on the surface thereof; supplying the developer to the surface of the developer-bearing member to hold the toner on the surface of the developer-bearing member by the micro closed electric fields; and developing a latent electrostatic image to a visible toner image by the toner. The toner is composed of a binder resin, a coloring agent and a quaternary ammonium salt serving as a charge controlling agent.

13 Claims, 2 Drawing Sheets

IMAGE FORMATION METHOD

BACKGROUND OF THE INVENTION

1. Field of the Invention

The present invention relates to an image formation method of developing a latent electrostatic image to a visible image using a toner which comprises a binder resin, a coloring agent and a charge controlling agent comprising a quaternary ammonium salt.

2. Discussion of Background

In conventional image formation apparatus, such as electrophotographic copying machines, printers and facsimile apparatus, in which latent electrostatic images are formed on a latent-electrostatic-image bearing member and developed to visible images by a developer, dry type development units using a powder-like developer are widely used.

As such powder-like developers, a two-component type developer comprising a toner and a carrier, and a one-component type developer comprising a toner without containing a carrier, are conventionally known.

A two-component type development method using the above two-component type developer is capable of yielding relatively stable, good recorded images, but has the shortcomings that the deterioration of the carrier is easily caused, and the mixing ratio of the toner and the carrier tends to change while in use, so that the maintenance of an apparatus using this method is complicated. Furthermore, the apparatus using the two-component type development method is relatively oversized.

From the above viewpoints, the primary focus of attention is on a one-component type development method using the one-component type developer, which does not have the above-mentioned shortcomings of the two-component type development method.

There are two types of one-component type developers. One is of a type which consists of a toner, while the other is of a type which consists of a mixture of a toner and an auxiliary agent.

Furthermore, there are two types of toners. One is a magnetic toner which contains magnetic particles, and the other is a non-magnetic toner which does not contain magnetic particles.

Generally, the above-mentioned magnetic particles are not transparent. Therefore, it is difficult to obtain clear color images including full-color images and multi-colored images by use of the magnetic toner. Therefore, it is preferable to employ the one-component type development method using the non-magnetic toner when the color images are to be obtained.

In U.S. patent application Ser. No. 597,881 (filed Nov. 12, 1990) and Ser. No. 674,161 (filed Mar. 25, 1991), Suzuki et al. disclose an image formation method in which a one-component type developer comprising a non-magnetic toner, when necessary with addition of auxiliary agents thereto, is supplied to the surface of a developer-bearing member which is rotatably driven to transport the developer into a development zone, where a latent-electrostatic-image-bearing member is directed to the above-mentioned developer-bearing member, so that the latent electrostatic images formed on the latent-electrostatic-image-bearing member are developed to visible images, characterized in that numerous micro closed electric fields are formed near the surface of the developer-bearing member by selectively causing the surface of the developer-bearing member to support electric charges, the charged toner is attracted by these closed electric fields to deposit the developer on the surface of the developer-bearing member, thereby developing the latent electrostatic images to visible toner images.

This method has many advantages over the conventional methods, including the advantage that the intensity of the electric fields can be significantly increased in comparison with the case where the conventional methods are employed, since a number of micro closed electric fields are formed near the surface of the developer-bearing member, and therefore a large amount of sufficiently charged toner can be deposited on the developer-bearing member and transported into the development zone.

According to the inventors of the present invention, however, in the above image formation method of forming numerous micro fields near the surface of the developer-bearing member, it is difficult to form a toner layer with a uniform thickness on the developer-bearing member in a stable manner when a conventional non-magnetic toner comprising a coloring agent and a resin is employed for the development of a latent-electrostatic image. The toner layer formed on the developer-bearing member becomes thin and accordingly the amount of the toner to be used for development is decreased. As a result, the following problems occur: The density of the obtained images is low, the toner layer is not uniform, and the images and the background are fogged. Furthermore, a thin film of toner is formed on the developer-bearing member, which is a so-called filming phenomenon. When this phenomenon takes place, the effect of the micro fields is reduced, and eventually the amount of the toner held by the developer-bearing member is decreased and it becomes difficult to supply a sufficient amount of the toner to the latent-electrostatic-image bearing member.

SUMMARY OF THE INVENTION

It is therefore an object of the present invention to provide an image formation method which is capable of forming a toner layer with a uniform thickness in a stable manner, preventing the occurrence of the so-called filming phenomenon, and yielding images with high quality and high image density for a long period of time.

The above object of the present invention can be achieved by an image formation method of developing a latent electrostatic image formed on a latent-electrostatic-image bearing member to a visible toner image by a one-component type developer consisting essentially of a toner, comprising the steps of (1) forming numerous micro closed electric fields near the surface of a developer-bearing member by causing the developer-bearing member to selectively hold electric charges on the surface thereof, (2) supplying the developer to the surface of the developer-bearing member to hold the toner on the surface of the developer-bearing member by the micro closed electric fields, and (3) developing a latent electrostatic image to a visible toner image by the toner, the toner comprising a binder resin, a coloring agent and a charge controlling agent comprising a quaternary ammonium salt.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
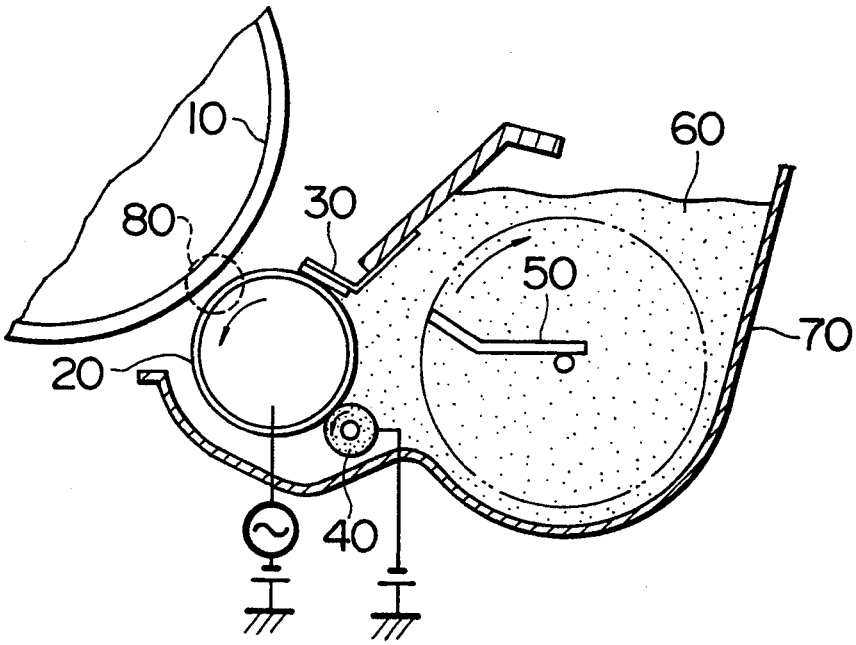
FIG. 1 is a schematic cross-sectional view of a development apparatus including a developer-bearing member on which a number of micro fields are formed, which is useful to carry out the present invention.

The toner for use in the present invention contains a charge controlling agent which comprises a quaternary ammonium salt. The quaternary ammonium salt has any of the following formulas:

(I)

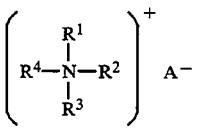

(II)

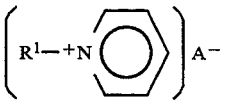

(III)

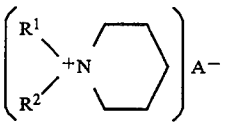

(IV)

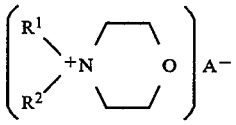

wherein $R^1$, $R^2$, $R^3$ and $R^4$ independently represent H, $-C_nX2_{n+1}$,

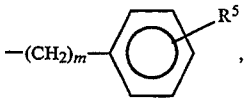

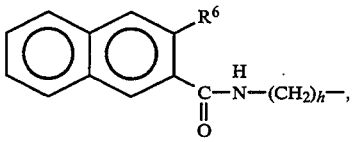

-continued

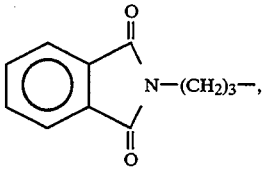

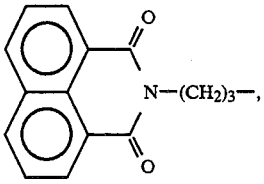

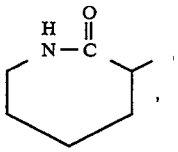

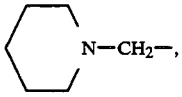

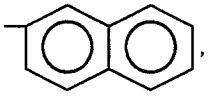

or

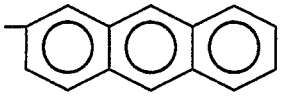

in which $R^5$represents —H, $-CH_3$, $-NH_2$, $-N(CH_3)_2$, $-OCH_3$, —Cl, $-NO_2$ or —CN; represents —H, —OH, $-OCH_3$ or $-OC_2H_5$; X represents H, Cl, F or Br; n is an integer of 1 to 24; m is an integer of 0 to 5; h is an integer of 1 to 4; and $A^-$ represents $F^-$, $Cl^-$, $Br^-$, $I^-$, $BF_4^-$,

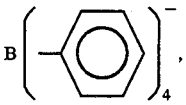

$PF_6^-$,

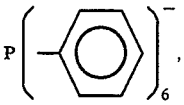

$ClO_4^-$, $SbF_6^-$, $SiF_6^-$, $(Mo_7O_7)^{6-}$, $(MoO_4)^{2-}$, $(Mo_7O_{24})^{2-}$, $(Mo_8O_{20})^{4-}$, $(SiMo_{12}O_{40})^{3-}$, $(PMo_{12}O_{40})^{3-}$, $(BMo_{12}O_{40})^{5-}$, $(OCr_2O_3 \cdot 12MoO_3)^{6-}$, $(H_2W_{12}O_{42})^{10-}$, $(WO_4)^{2-}$, $(H_2W_{12}O_{40})^{6-}$, $(PO_4W_{12}O_{36})^{3-}$, $(SiW_{12}O_{40})^{4-}$, $(FeW_{12}O_{40})^{5-}$, $HNO_2^-$, $C_pH_{2p+1}COO^-$,

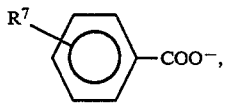
$CH_3SO_3^-$, $C_2H_5SO_3^-$,
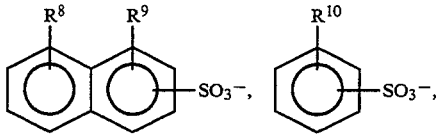
$CH_3SO_4^-$, $C_2H_5SO_4^-$, or $SO_4^{2-}$ in which $R^7$, $R^8$, $R^9$ and $R^{10}$ independently represent —H, —F, —Cl, —$CH_3$, —OH, —$NH_2$ or —$NO_2$; and p is an integer of 0 to 24.
Specific examples of the quaternary ammonium salts employed as the charge controlling agent are as follows:
TABLE 1
(1)
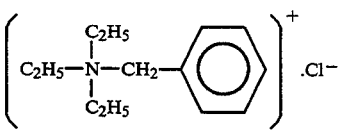
(2)
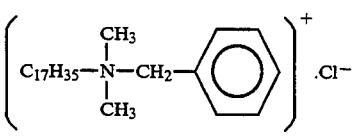
(3)
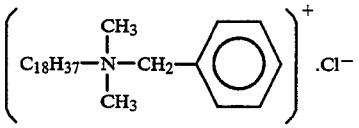
(4)
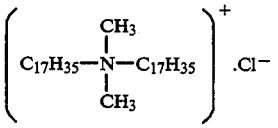
(5)
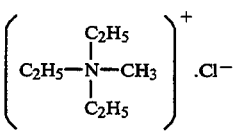
(6)
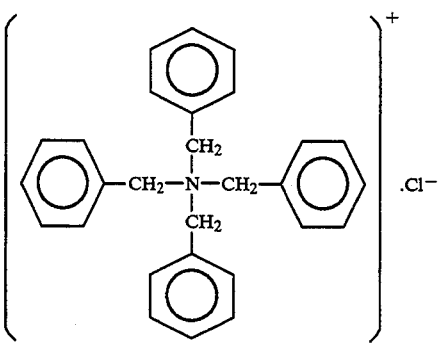
(7)
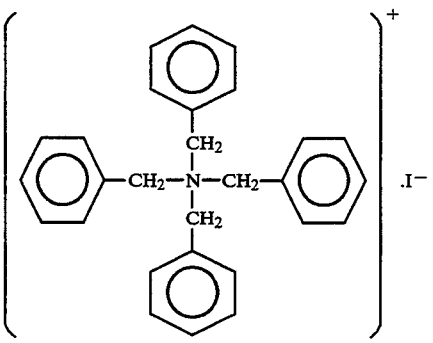
(8)
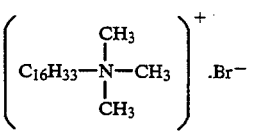
(9)
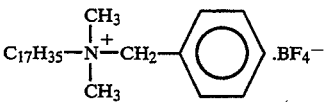
(10)
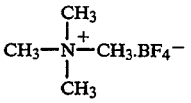
(11)
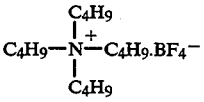
(12)
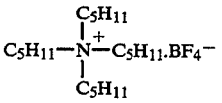

TABLE 1-continued
(13)
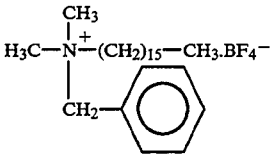
(14)
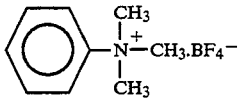
(15)
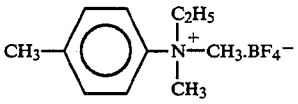
(16)
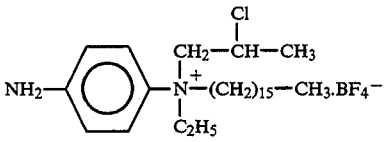
(17)
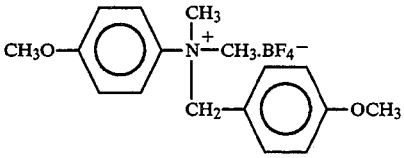
(18)
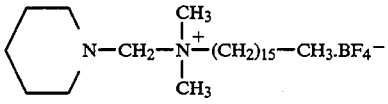
(19)
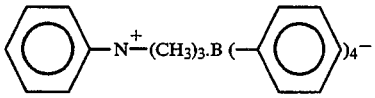
(20)
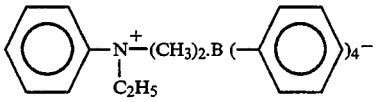
(21)
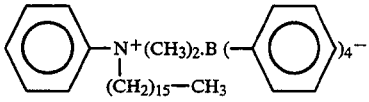
(22)
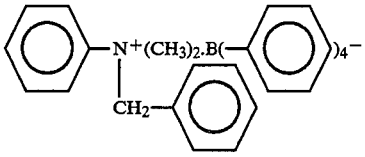
(23)
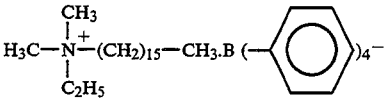
(24)
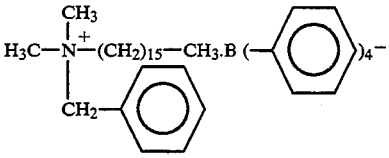
(25)
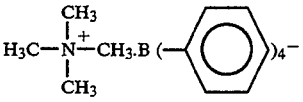
(26)
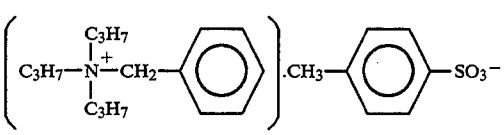
(27)
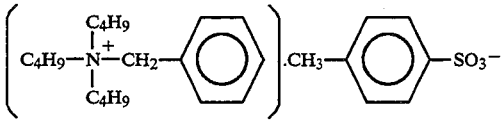
(28)
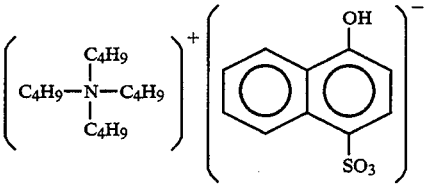
(29)
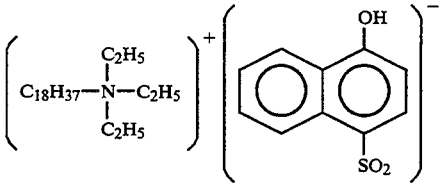
(30)
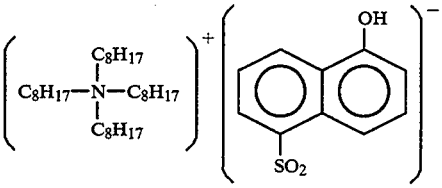

TABLE 1-continued
(31)
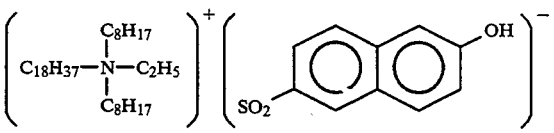
(32)
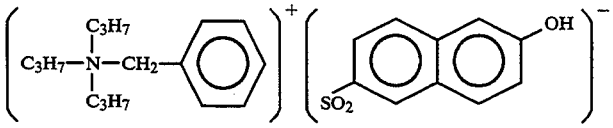
(33)
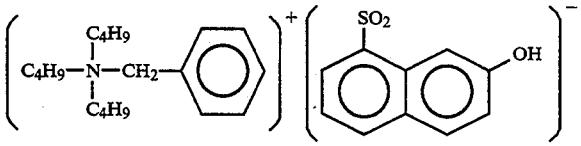
(34)
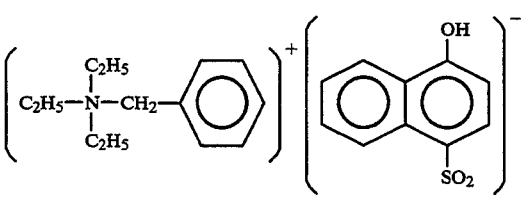
(35)
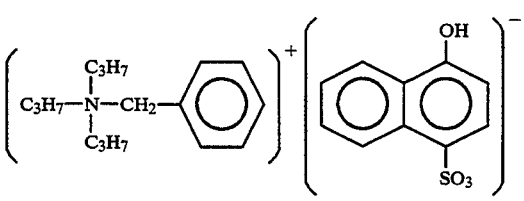
(36)
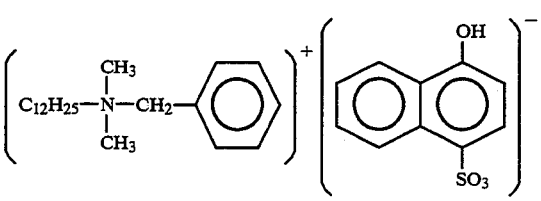
(37)
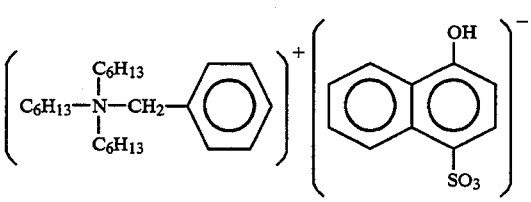
(38)
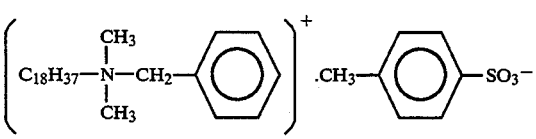
(39)
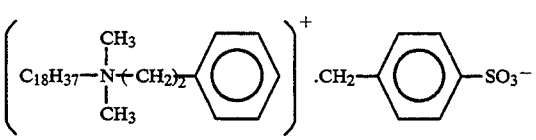
(40)
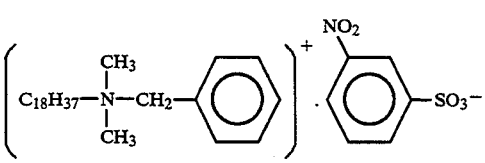
(41)
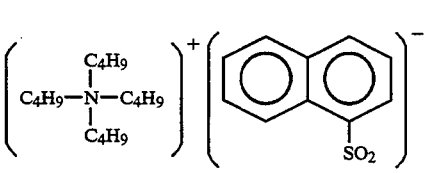
(42)
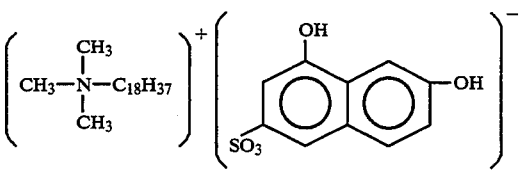
(43)
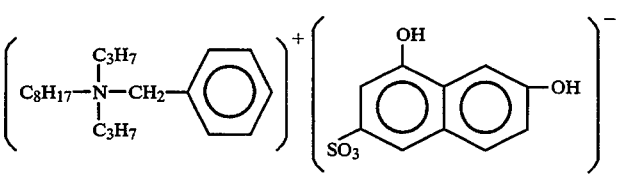

TABLE 1-continued
(44)
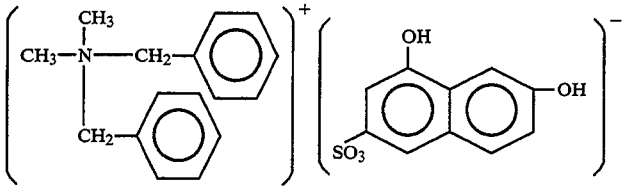
(45)
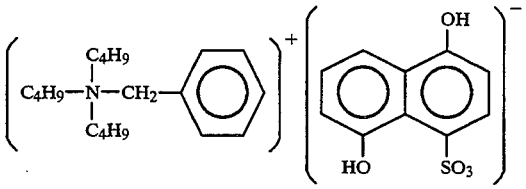
(46)
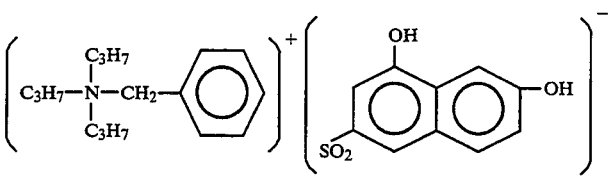
(47)
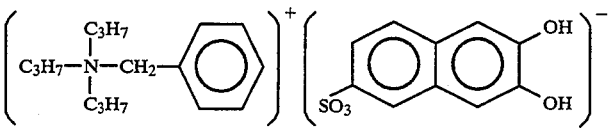
(48)
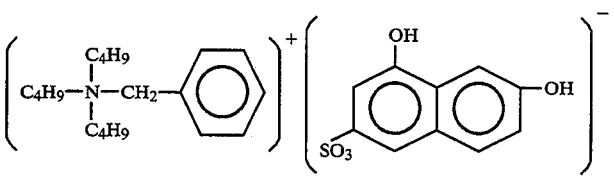
(49)
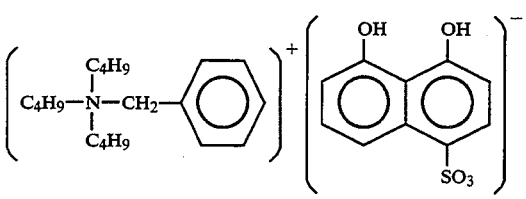
(50)
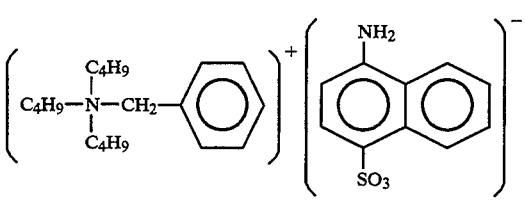
(51)
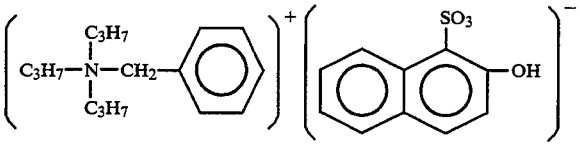
(52)
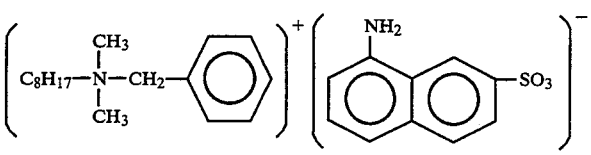

TABLE 1-continued
(53)
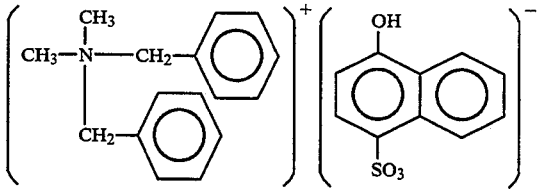
(54)
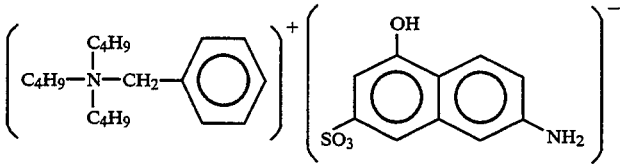
(55)
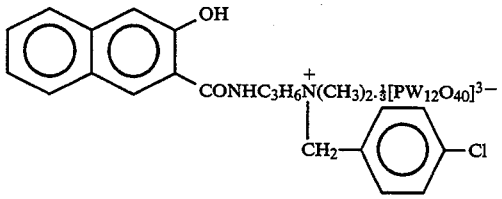
(56)
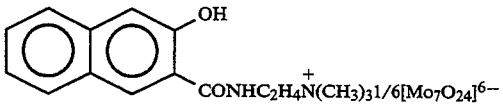
(57)
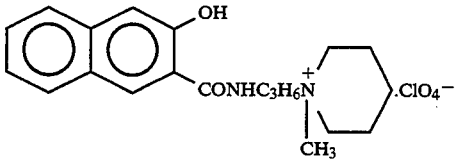
(58)
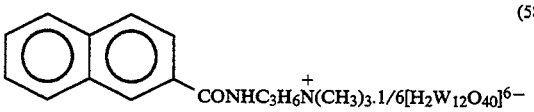
(59)
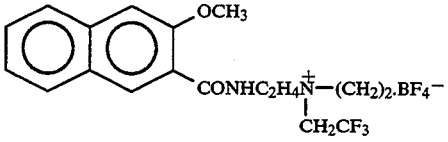
(60)
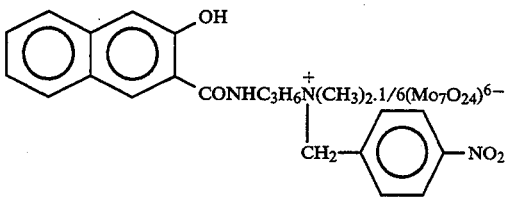
(61)
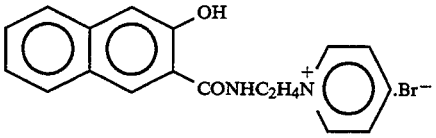
(62)
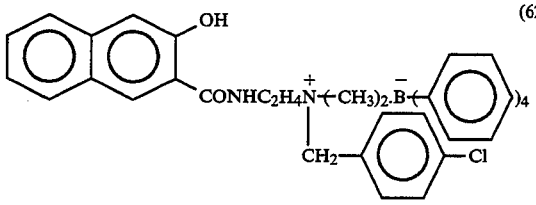
(63)
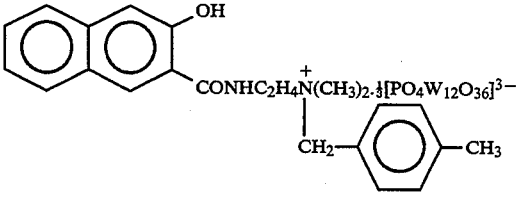
(64)
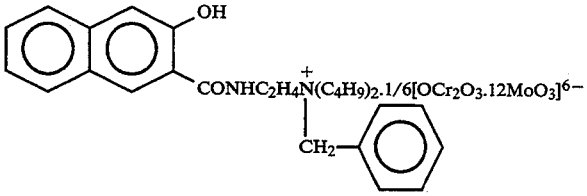

TABLE 1-continued
(65)
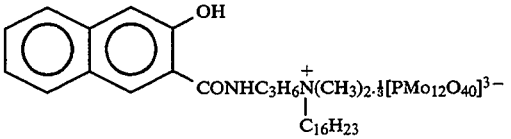
(66)
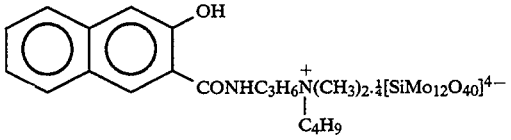
(67)
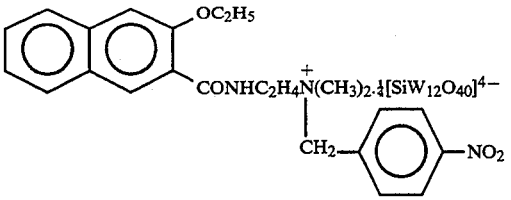
(68)
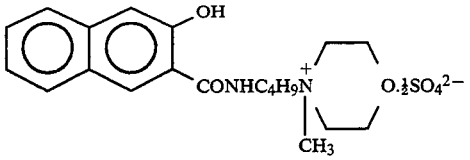
(69)
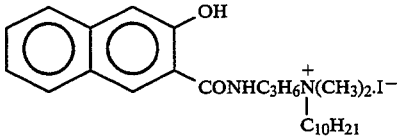
(70)
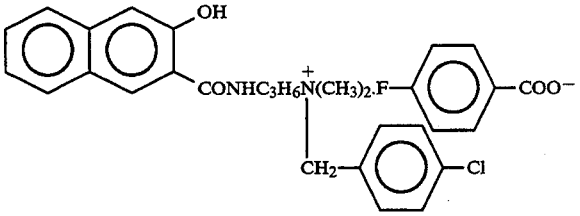
(71)
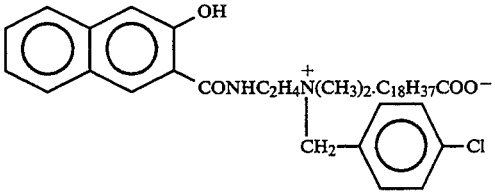
(72)
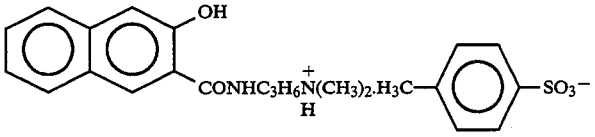
(73)
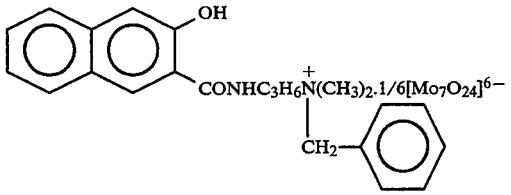
(74)
$C_{16}H_{33}\overset{+}{N}(CH_3)_3 \cdot 1/6[Mo_7O_{24}]^{6-}$
$C_{18}H_{37}\overset{+}{N}(CH_3)_3 \cdot 1/10[H_2W_{12}O_{42}]^{10-}$
(75)
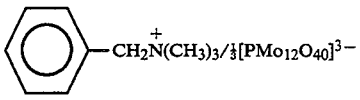
(76)
$C_4H_9\overset{+}{N}(CH_3)_3 \cdot 1/5[BMo_{12}O_{40}]^{5-}$
(77)
$C_{10}H_{21}\overset{+}{N}(CH_3)_3 \cdot 1/6[Mo_7O_{24}]^{6-}$
(78)
$C_{16}H_{33}\overset{+}{N}(CH_3)_3 \cdot 1/6[H_2W_{12}O_{40}]^{6-}$
(79)
$C_{20}H_{41}\overset{+}{N}(CH_3)_3 \cdot ¼[SiW_{12}O_{40}]^{4-}$
(80)

TABLE 1-continued
(81) 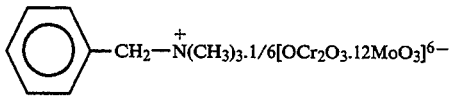
(82) 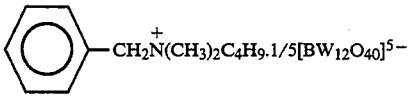
(83) 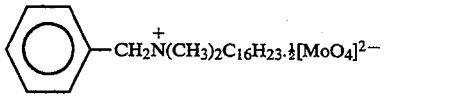
(84) 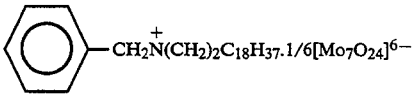
(85) 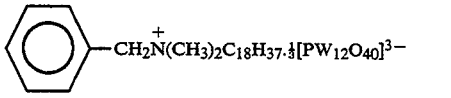
(86) 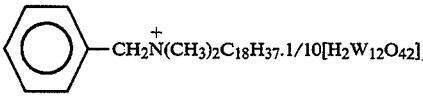
(87) 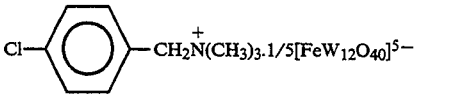
(88) 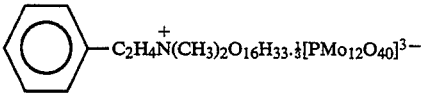
(89) 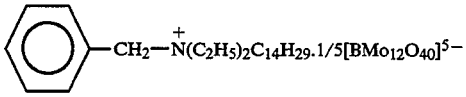
(90) 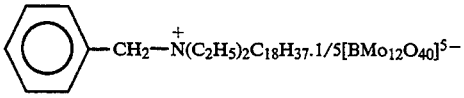
(91) 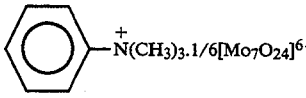
(92) 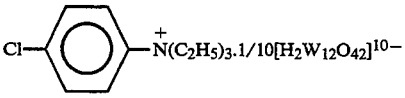
(93) 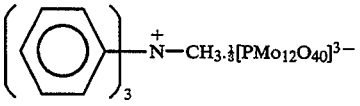
(94) 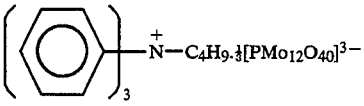
(95) 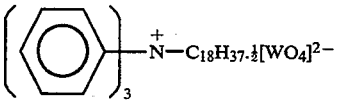
(96) 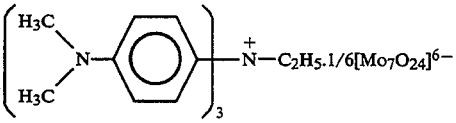
(97) 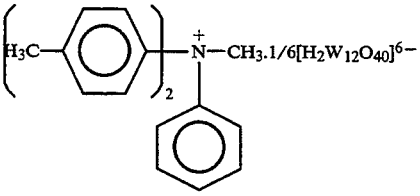
(98) 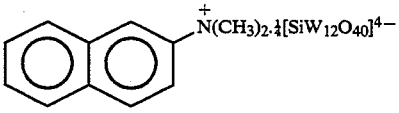
(99) 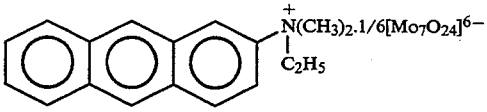
(100) $C_{16}H_{33}\overset{+}{N}(CH_3)_{3.}\frac{1}{4}[Mo_8O_{26}]^{4-}$
(101) 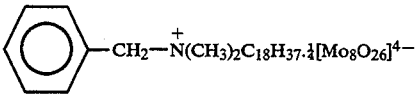
(102) $C_{18}H_{27}\overset{+}{N}(CH_2)_{2.}1/7[PMo_{11}O_{39}]^{7-}$
(103) $[C_{16}H_{33}N^{+}(CH_3)_3]1.\frac{1}{2}[Mo_7O_{24}]^{2-}$
(104) $[C_{18}H_{37}\overset{+}{N}(CH_3)_3]_3(\overset{+}{N}H_4)_3[Mo_7O_{24}]^{6-}$ TABLE 1-continued
(105)
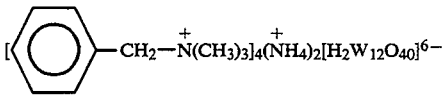
(106)
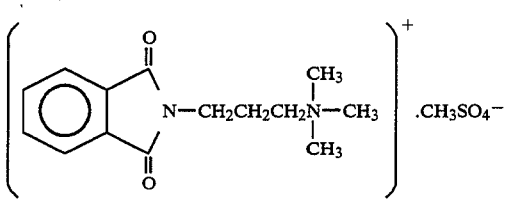
(107)
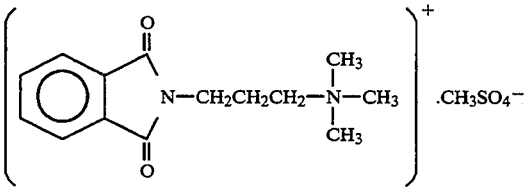
(108)
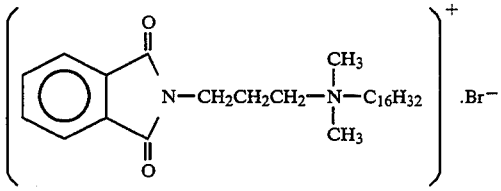
(109)
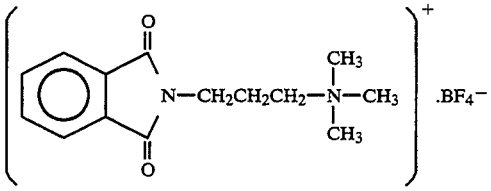
(110)
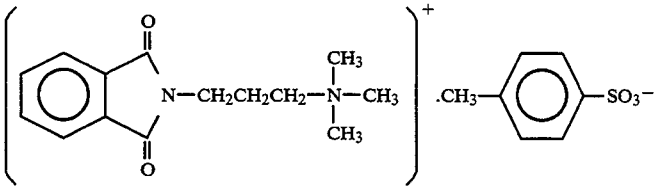
(111)
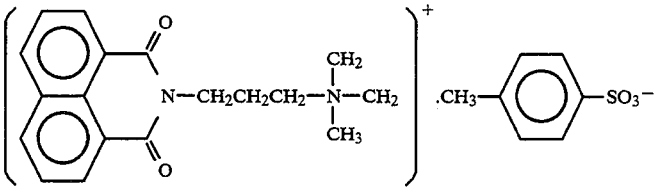
(112)
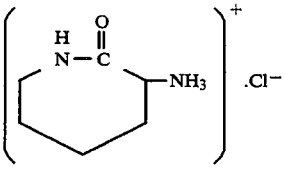
(113)
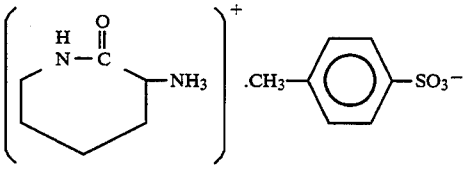
(114)
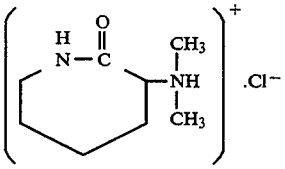
(115)
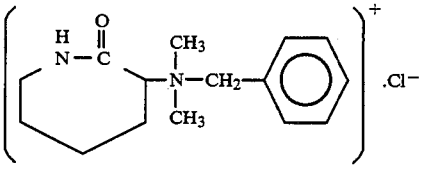
(116)
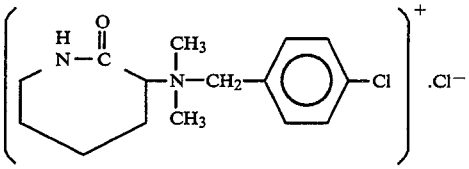

TABLE 1-continued (117)

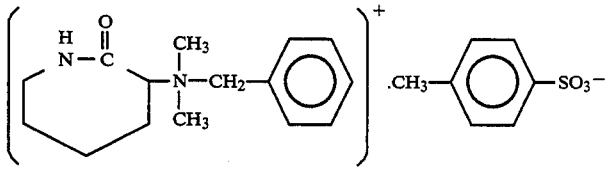

(118)

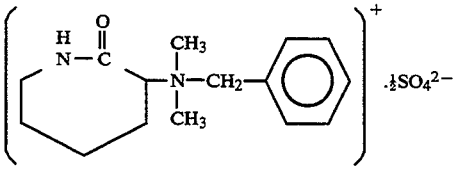

(119)

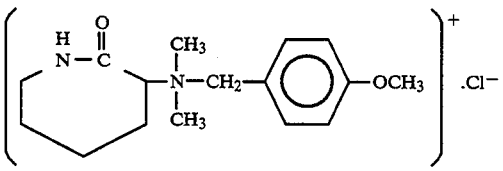

(120)

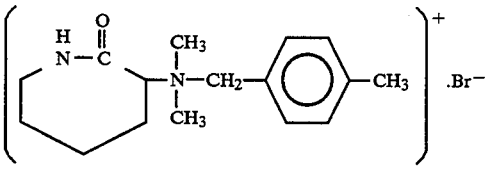

(121)

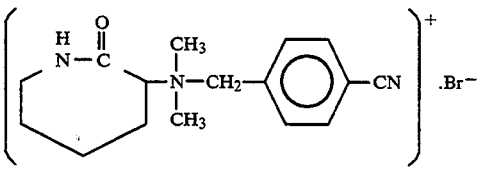

(122)

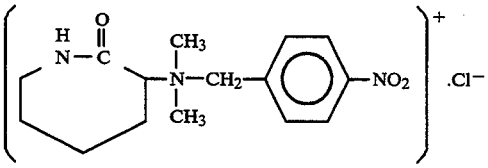

(123)

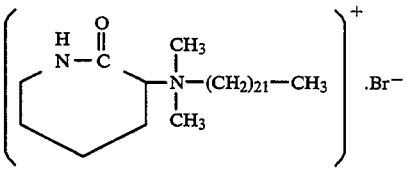

(124)

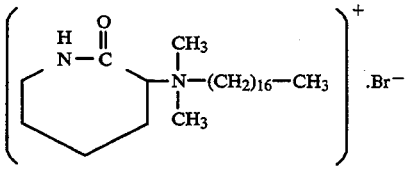

In the toner for use in the present invention, any of binder resins employed in the conventional toners can be employed. More specifically, the following binder resins can be employed: homopolymers of styrene or its substitution compounds such as polystyrene, polychlorostyrene and polyvinyltoluene; styrene copolymers such as styrene—p-chlorostyrene copolymer, styrene—propylene copolymer, styrene—vinyltoluene copolymer, styrene—vinylnaphthalene copolymer, styrene—methyl acrylate copolymer, styrene—ethyl acrylate copolymer, styrene—butyl acrylate copolymer, styrene—octyl acrylate copolymer, styrene—methyl methacrylate copolymer, styrene—ethyl methacrylate copolymer, styrene—butyl methacrylate copolymer, styrene—methyl α-chloromethacrylate copolymer, styrene—acrylonitrile copolymer, styrene—vinyl methyl ether copolymer, styrene—vinyl ethyl ether copolymer, styrene—vinyl methyl ketone copolymer, styrene—butadiene copolymer, styrene—isoprene copolymer, styrene—acrylonitrile—indene copolymer, styrene—maleic acid copolymer, and styrene—maleic acid ester copolymer; and other resins such as polymethyl methacrylate, polybutyl methacrylate, polyvinyl chloride, polyvinyl acetate, polyethylene, polypropylene, polyester, polyvinyl butylbutyral, polyacrylic acid resin, rosin, modified rosin, terpene resin, phenolic resin, aliphatic hydrocarbon resin, alicyclic hydrocarbon resin, aromatic petroleum resin, chlorinated paraffin and paraffin wax. These binder resins can be used alone or in combination.

As a coloring agent for use in the toner in the image formation method of the present invention, any of pigments and dyes employed in the conventional toners can be employed. More specifically, the following coloring agents can be employed: carbon black, lamp black, iron black, ultramarine, Nigrosine dye, Aniline Blue, Calconyl Blue, Du Pont Oil Red, Quinoline Yellow, Methylene Blue Chloride, Phthalocyanine Blue, Phthalocyanine Green, Hansa Yellow G, Rhodamine 6C Lake, Chrome Yellow, Quinacridone, Benzidine Yellow, Malachite Green, Malachite Green Hexalate, Oil Black, Azo Oil Black, Rose Bengale, monoazo dyes, disazo dyes, and trisazo dyes.

It is preferable that the amount ratio of the quaternary ammonium salt and the coloring agent to 100 parts by weight of the binder resin be respectively 0.1–10 parts by weight and 0.5–10 parts by weight.

Furthermore, lubricants can be added to the toner in the image formation method of the present invention. Examples of the lubricant include synthetic waxes such as low-molecular-weight polyethylene and polypropylene; vegetable waxes such as candelilla wax, carnauba wax, rice wax, and haze wax; animal waxes such as beeswax, lanolin, and whale wax; mineral waxes such as montan wax and ozokerite; and fatty waxes such as hardened castor oil, hydroxystearic acid, fatty amides, and phenol fatty esters. It is preferable that the amount ratio of the lubricant to 100 parts by weight of the binder resin be 1–10 parts by weight.

In addition to the above-mentioned binder resins and coloring agents, varieties of plasticizers such as dibutyl phthalate and dioctyl phthalate, and resistivity-controlling agents such as tin oxide, lead oxide and antimony oxide, can be added to the toner for use in the present invention, in order to adjust the thermal characteristics, electrical characteristics and physical characteristics thereof.

Moreover, finely-divided particles of colloidal silica, titanium oxide and aluminum oxide can be added to the toner for use in the present invention in order to impart fluidity thereto.

With reference to the accompanying drawings, the above-mentioned image formation method will now be explained.

FIG. 1 schematically shows a representative development apparatus which includes a developer-bearing member. This development apparatus is suitable for the image formation method of the present invention. In the figure, a toner 60 which is held in a toner tank 70 is forced to move toward a toner supply member 40 by a stirring blade 50 serving as a toner-supply auxiliary member, so that the toner 60 is supplied to the toner supply member 40. It is preferable to employ a urethane or acrylic sponge roller or a slightly positively chargeable fur brush as the toner supply member 40. When the development is finished, a developer-bearing member 20 is rotated in the direction of the arrow, for example, at a rotation speed of 400 rpm, and reaches a portion where the developer-bearing member 20 comes into contact with the toner supply member 40. The toner supply member 40 is rotated in the direction opposite to the rotary direction of the developer-bearing member 20, and applies electric charges to both the developer-bearing member 20 and the toner 60, so that the toner 60 is deposited on the developer-bearing member 20. The developer-bearing member 20 is further rotated and the electric charge of the toner deposited on the developer-bearing member 20 is stabilized as the thickness of a toner layer is regulated by a toner-layer-thickness-regulation member 30. It is preferable that the toner-layer-thickness-regulation member 30 be made of an elastic material which can be brought into pressure contact with the developer-bearing member 20. In particular, it is preferable that a portion where the toner-layer-thickness-regulation member 30 comes into contact with the developer-bearing member 20 be made of a resin layer with a negative polarity, such as a resin layer made of a fluorocarbon resin. The toner layer on the developer-bearing member 20 then reaches a development zone 80, where the latent electrostatic images are developed to visible toner images by either a contact development or a non-contact development. When necessary, a D.C. voltage, A.C. voltage, a D.C.-superimposed A.C. voltage or a bias voltage, for instance, in the form of pulses, may be applied to the developer-bearing member 20 and the toner supply member 40 in order to optimize the quality of the developed images.

Figure 2:
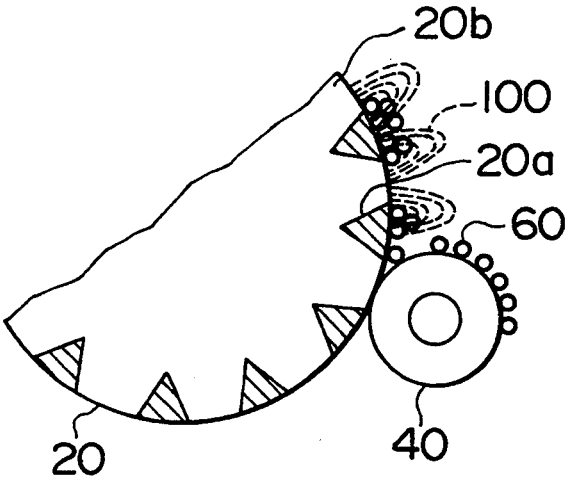
FIG. 2 is a schematic cross-sectional view of the developer-bearing member shown in FIG. 1, on which micro closed fields are formed.

The mechanism of the toner deposition onto the developer-bearing member 20 of an electrode type will now be explained. An example of the developer-bearing member 20 is shown in FIG. 2. As shown in the figure, the surface of the developer-bearing member 20 is composed of a number of minute dielectric portions 20*a* and minute electro-conductive portions 20*b* which are mixedly distributed. When the shape of each portion is circular, each of the portions has a diameter in the range of 30 to 2000 μm, preferably 100 to 400 μm, and these portions are arranged at random or in a certain order. It is preferable that the total area ratio of the dielectric portions 20*a* be in the range of 50 to 80% of the entire surface of the developer-bearing member 20. It is preferable that the dielectric portions 20*a* of the developer-bearing member 20 be made of a dielectric material such as a fluorocarbon resin.

The deposition of the toner 60 on the developer-bearing member 20 takes place as follows: After the development process, the developer-bearing member 20 is rotated in the direction of the arrow and comes into contact with the toner supply member 40. The toner which has not be used for development and remains on the developer-bearing member 20 is mechanically and/or electrically scraped off by the toner supply member 40 and the dielectric portions 20*a* are tribo-electrically charged. By this triboelectric charging, the electric charge of the developer-bearing member 20 and that of the toner 60 on the developer-bearing member 20 which occured during the previous development process are made constant and initialized for the next development. The toner carried by the toner supply member 40 is tribo-electrically charged and electrostatically deposited on the dielectric portions 20*a* of the developer-bearing member 20. At this moment, the polarity of the toner is opposite to that of a latent-electrostatic-image-bearing member 10, and the polarity of the dielectric portions 20*a* of the developer-bearing member 20 is the same as that of the latent-electrostatic-image-bearing member 10.

The electric fields formed on the developer-bearing member 20 are micro closed fields 100 with a large electric field inclination as illustrated in FIG. 2, so that the toner can be deposited thereon in multiple layers. Because of the micro closed fields 100, the toner deposited on the developer-bearing member 20 is strongly attracted to the developer-bearing member 20 and is therefore hardly separated therefrom.

The thickness of the toner layer formed on the developer-bearing member 20 is regulated by the toner-layer-thickness-regulating member 30, and the toner layer reaches the development zone 80. Because the electric field between the developer-bearing member 20 and the latent-electrostatic-image-bearing member 10 in the development zone 80 has a large electrode effects, the toner deposited on the developer-bearing member 20 is strongly attracted to the latent-electrostatic-image-bearing member 10, so that the latent electrostatic images are developed into visible images.

Figure 3A:
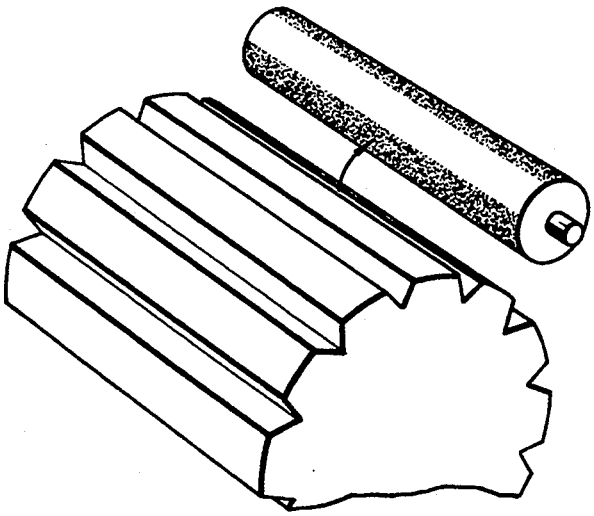
FIG. 3(*a*) to 3(*c*) are the schematic cross-sectional views of the developer-bearing member for use in a development apparatus of the type shown in FIG. 1, in particular showing the surface conditions of the developer-bearing member in the course of the production thereof.
Figure 3B:
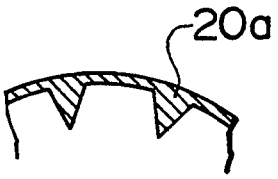
Figure 3C:
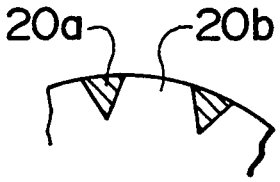

The developer-bearing member for use in the present invention can be made, for example, by the following steps:

(i) V-grooves are formed on the surface of a metal roller by knurling in such a manner that the V-grooves have a pitch of 0.1 to 0.5 mm, with an inclination of about 45° C. with respect to the longitudinal direction of the metal roller, as illustrated in FIG. 3(*a*).

(ii) A fluorocarbon resin (Trademark "Lumifron LF200", made by Asahi Glass Co., Ltd.) is then coated on the V-grooves formed surface of the metal roller, and cured and dried at 100° C. for about 30 minutes, so that the grooves are completely filled with the fluorocarbon resin, as illustrated in FIG. 3(*b*).

(iii) The surface of the roller is cut or polished in such a manner that the minute electroconductive portions 20b and the minute dielectric portions 20a are mixedly distributed, with the total area ratio of the electroconductive portions to the entire surface being in the range of 20 to 50% as illustrated in FIG. 3(*c*).

The developer-bearing member can also be made by using various kinds of materials and methods. For instance, the developer-bearing member can be made by molding an electro-conductive rubber with concaves on the surface thereof, coating the concaves with an insulating material, and polishing it.

In the above image formation method of forming numerous micro fields near the surface of the developer-bearing member, it is difficult to form a toner layer with a uniform thickness on the developer-bearing member in a stable manner when a conventional non-magnetic toner comprising a coloring agent and a resin is employed for the development of a latent-electrostatic image. The toner layer formed on the developer-bearing member becomes thin and accordingly the amount of the toner to be used for development is decreased. As a result, the following problems occur: The density of the obtained images is low, the toner layer is not uniform, and the images and the background are fogged. Furthermore, the filming phenomenon takes place. When this phenomenon occurs, the effect of the micro fields is reduced, and eventually the amount of the toner held by the developer-bearing member is decreased and it becomes difficult to supply a sufficient amount of the toner to the latent-electrostatic-image bearing member.

When the toner comprising the previously mentioned charge controlling agent which comprises the quaternary ammonium salt is employed for the above image formation method, the toner is prevented from being scattered on the developer-bearing member. As a result, the toner filming on the developer-bearing member is not caused. Therefore the image formation method of the present invention can make the best use of the effects of the micro fields and provide the images with high quality and high image density for a long period of time.

The features of this invention will become apparent in the course of the following description of exemplary embodiments which are given for illustration of the invention and are not intended to be limiting thereof.

EXAMPLE 1

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 8 in Table 1 (charge controlling agent) | 2 |

The pulverized mixture was then classified to obtain finely-divided particles with an average particle size of 11 μm. 100 parts by weight of the above obtained finely-divided particles and 0.2 parts by weight of finely-divided particles of colloidal silica were mixed, so that a positively-chargeable toner No. 1 was obtained. This toner was then incorporated in a development apparatus (Trademark "FT4530", made by Ricoh Co., Ltd.), with the development section thereof partly modified, provided with a developer-bearing member as shown in FIG. 3(*a*) having a cross section as shown in FIG. 3(*c*) which was mixedly composed of minute dielectric portions and minute electroconductive portions on the surface thereof, with the total area ratio of the dielectric portions being 50% of the entire surface. An image was developed by use of an organic photoconductor under application of a potential of −750 V, so that a clear image with high density and free from the fogging were obtained.

Even after 5000 copies were made, the filming of the toner on the developer-bearing member did not occur, and clear images were obtained.

EXAMPLE 2

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 9 in Table 1 (charge controlling agent) | 2 |

The pulverized mixture was then classified to obtain finely-divided particles with an average particle size of 12 μm. 100 parts by weight of the above obtained finely-divided particles and 0.3 parts by weight of finely-divided particles of titanium oxide were mixed, so that a positively-chargeable toner No. 2 was obtained.

Image formation was performed using the above obtained toner No. 2 in the same manner as in Example 1, so that a clear image with high density and free from the fogging was obtained.

Even after 5000 copies were made, the filming of the toner on the developer-bearing member did not occur, and clear images were obtained.

EXAMPLE 3

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |

-continued

| | parts by weight |
|---|---|
| Carbon black (coloring agent) | 8 |
| Compound No. 26 in Table 1 (charge controlling agent) | 2.5 |

The pulverized mixture was then classified to obtain finely-divided particles with an average particle size of 11 μm. 100 parts by weight of the above obtained finely-divided particles and 0.2 parts by weight of finely-divided particles of colloidal silica were mixed, so that a positively-chargeable toner No. 3 was obtained.

Image formation was performed using the above obtained toner No. 3 in the same manner as in Example 1, so that a clear image with high density and free from the fogging was obtained.

Even after 5000 copies were made, the filming of the toner on the developer-bearing member did not occur, and clear images were obtained.

EXAMPLE 4

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 38 in Table 1 (charge controlling agent) | 2.5 |

The pulverized mixture was then classified to obtain finely-divided particles with an average particle size of 12 μm. 100 parts by weight of the above obtained finely-divided particles and 0.3 parts by weight of finely-divided particles of titanium oxide were mixed, so that a positively-chargeable toner No. 4 was obtained.

Image formation was performed using the above obtained toner No. 4 in the same manner as in Example 1, so that a clear image with high density and free from the fogging was obtained.

Even after 5000 copies were made, the filming of the toner on the developer-bearing member did not occur, and clear images were obtained.

EXAMPLE 5

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |

-continued

| | parts by weight |
|---|---|
| Carbon black (coloring agent) | 8 |
| Compound No. 40 in Table 1 (charge controlling agent) | 2 |

The pulverized mixture was then classified to obtain finely-divided particles with an average particle size of 11 μm. 100 parts by weight of the above obtained finely-divided particles and 0.2 parts by weight of finely-divided particles of colloidal silica were mixed, so that a positively-chargeable toner No. 5 was obtained.

Image formation was performed using the above obtained toner No. 5 in the same manner as in Example 1, so that a clear image with high density and free from the fogging was obtained.

Even after 5000 copies were made, the filming of the toner on the developer-bearing member did not occur, and clear images were obtained.

EXAMPLE 6

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 41 in Table 1 (charge controlling agent) | 2 |

The pulverized mixture was then classified to obtain finely-divided particles with an average particle size of 12 μm. 100 parts by weight of the above obtained finely-divided particles and 0.3 parts by weight of finely-divided particles of titanium oxide were mixed, so that a positively-chargeable toner No. 6 was obtained.

Image formation was performed using the above obtained toner No. 6 in the same manner as in Example 1, so that a clear image with high density and free from the fogging was obtained.

Even after 5000 copies were made, the filming of the toner on the developer-bearing member did not occur, and clear images were obtained.

EXAMPLE 7

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |

-continued

| | parts by weight |
|---|---|
| Carbon black (coloring agent) | 8 |
| Compound No. 55 in Table 1 (charge controlling agent) | 2 |

The pulverized mixture was then classified to obtain finely-divided particles with an average particle size of 11 μm. 100 parts by weight of the above obtained finely-divided particles and 0.2 parts by weight of finely-divided particles of colloidal silica were mixed, so that a positively-chargeable toner No. 7 was obtained.

Image formation was performed using the above obtained toner No. 7 in the same manner as in Example 1, so that a clear image with high density and free from the fogging was obtained.

Even after 5000 copies were made, the filming of the toner on the developer-bearing member did not occur, and clear images were obtained.

EXAMPLE 8

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 76 in Table 1 (charge controlling agent) | 2 |

The pulverized mixture was then classified to obtain finely-divided particles with an average particle size of 12 μm. 100 parts by weight of the above obtained finely-divided particles and 0.3 parts by weight of finely-divided particles of titanium oxide were mixed, so that a positively-chargeable toner No. 8 was obtained.

Image formation was performed using the above obtained toner No. 8 in the same manner as in Example 1, so that a clear image with high density and free from the fogging was obtained.

Even after 5000 copies were made, the filming of the toner on the developer-bearing member did not occur, and clear images were obtained.

EXAMPLE 9

A mixture of the following components was fused and kneaded under application of heat thereto. The mixture was then cooled and ground in a hammer mill, followed by

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 111 in Table 1 (charge controlling agent) | 2.5 |

The pulverized mixture was then classified to obtain finely-divided particles with an average particle size of 11 μm. 100 parts by weight of the above obtained finely divided particles and 0.2 parts by weight of finely-divided particles of colloidal silica were mixed, so that a positively-chargeable toner No. 9 was obtained.

Image formation was performed using the above obtained toner No. 9 in the same manner as in Example 1, so that a clear image with high density and free from the fogging was obtained.

Even after 5000 copies were made, the filming of the toner on the developer-bearing member did not occur, and clear images were obtained.

EXAMPLE 10

A mixture of the following components was fused and kneaded under application of heat thereto. The mixture was then cooled and ground in a hammer mill, followed by pulverizing with an air-jet type pulverizer.

| | parts by weight |
|---|---|
| Styrene - 2-ethylhexylacrylate - n-butylmethacrylate copolymer (amount ratio: 80:15:5) (binder resin) | 95 |
| Low-molecular-weight polypropylene (lubricant) | 5 |
| Carbon black (coloring agent) | 8 |
| Compound No. 117 in Table 1 (charge controlling agent) | 2.5 |

The pulverized mixture was then classified to obtain finely-divided particles with an average particle size of 12 μm. 100 parts by weight of the above obtained finely-divided particles and 0.3 parts by weight of finely-divided particles of titanium oxide were mixed, so that a positively-chargeable toner No. 10 was obtained.

Image formation was performed using the above obtained toner No. 10 in the same manner as in Example 1, so that a clear image with high density and free from the fogging was obtained.

Even after 5000 copies were made, the filming of the toner on the developer-bearing member did not occur, and clear images were obtained.

COMPARATIVE EXAMPLE 1

The procedure for preparing the toner in Example 1 was repeated except that 2 parts by weight of the charge controlling agent (Compound No. 8) employed in Example 1 was not used, so that a comparative toner was obtained.

Image formation was performed using the above obtained comparative toner in the same manner with Example 1. The density of the obtained image was lower than the image densities obtained by the toners No. 1 to No. 10 prepared in Examples 1 to 10. Moreover, the fogging of the images was observed and the image density of the solid area was not uniform.

The developer-bearing member was taken out from the development apparatus to inspect the surface of the developer-bearing member. A non-uniform toner layer was observed. Then the entire toner deposited on the developer-bearing member was sucked to observe the filming of the toner on the developer-bearing member. The filming of the toner was actually observed.

Because the positively-chargeable toner comprising the charge controlling agent which comprises the quaternary ammonium salt is employed for development of the latent-electrostatic image in the image formation method of the present invention, the toner layer with a uniform thickness can be formed on the developer-bearing member in a stable manner, the filming of the toner on the developer-bearing member is prevented and the images with high quality and high image density can be obtained for a long period of time.

What is claimed is:

1. An image formation method of developing a latent electrostatic image formed on a latent-electrostatic-image bearing member to a visible toner image by a one-component type developer consisting essentially of a toner, comprising the steps of (1) forming numerous micro closed electric fields near the surface of a developer-bearing member by causing said developer-bearing member to selectively hold electric charges on the surface thereof, (2) supplying said developer to the surface of said developer-bearing member to hold said toner on the surface of said developer-bearing member by said micro closed electric fields, and (3) developing a latent electrostatic image to a visible toner image by said toner, said toner comprising a binder resin, a coloring agent and a charge controlling agent comprising a quaternary ammonium salt.

2. The image formation method as claimed in claim 1, wherein said toner is a non-magnetic toner.

3. The image formation method as claimed in claim 1, wherein said quaternary ammonium salt has formula (I):

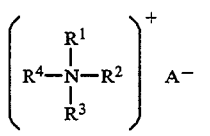

(I)

in which $R^1$, $R^2$, $R^3$ and $R^4$ independently represent H, $-C_nX_{2n+1}$,

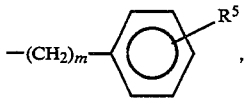

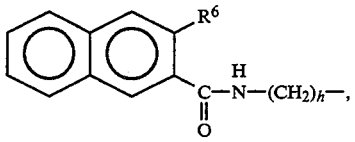

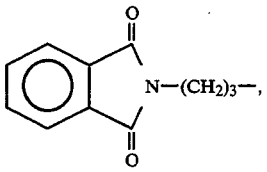

-continued

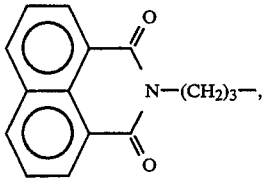

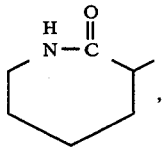

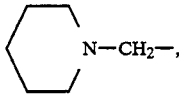

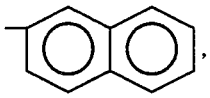

or

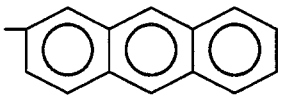

in which $R^5$ represents —H, $-CH_3$, $-NH_2$, $-N(CH_3)_2$, $-OCH_3$, —Cl, $-NO_2$ or —CN; $R^6$ represents —H, —OH, $-OCH_3$ or $-OC_2H_5$; X represents H, Cl, F or Br; n is an integer of 1 to 24; m is an integer of 0 to 5; h is an integer of 1 to 4; and $A^-$ represents $F^-$, $Cl^-$, $Br^-$, $I^-$, $BF_4^-$,

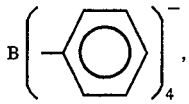

$PF_6^-$,

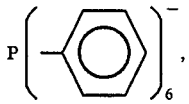

$ClO_4^-$, $SbF_6^-$, $SiF_6^-$, $(Mo_7O_7)^{6-}$, $(MoO_4)^{2-}$, $(Mo_7O_{24})^{2-}$, $(Mo_8O_{20})^{4-}$, $(SiMo_{12}O_{40})^{3-}$, $(PMo_{12}O_{40})^{3-}$, $(BMo_{12}O_{40})^{5-}$, $(OCr_2O_3 \cdot 12MoO_3)^{6-}$, $(H_2W_{12}O_{42})^{10-}$, $(WO_4)^{2-}$, $(H_2W_{12}O_{40})^{6-}$, $(PO_4W_{12}O_{36})^{3-}$, $(SiW_{12}O_{40})^{4-}$, $(FeW_{12}O_{40})^{5-}$, $HNO_2^-$, $C_pH_{2p+1}COO$

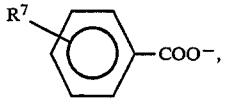

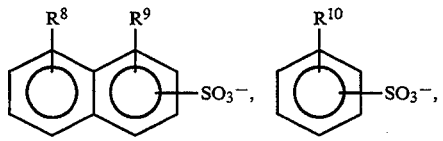

$CH_3SO_4^-$, $C_2H_5SO_4^-$, or $SO_4^{2-}$, in which $R^7$, $R^8$, $R^9$ and $R^{10}$ independently represent —H, —F, —Cl, —$CH_3$, —OH, —$NH_2$ or —$NO_2$; and p is an integer of 0 to 24.

4. The image formation method as claimed in claim 1, wherein said quaternary ammonium salt has formula (II):

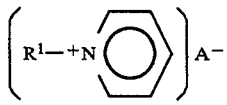

(II)

in which $R^1$ represents H, —$C_nX_{2n+1}$,

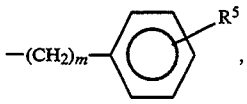

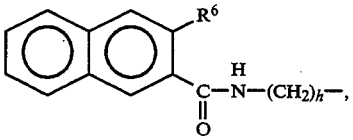

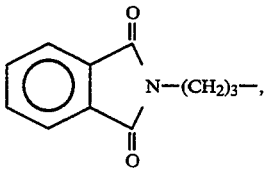

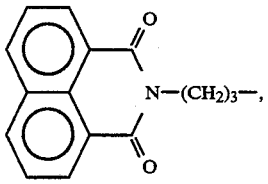

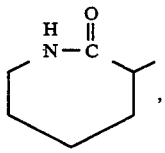

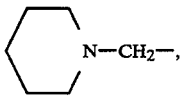

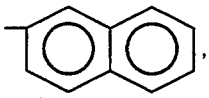

or

-continued

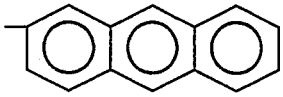

in which $R^5$ represents —H, —$CH_3$, —$NH_2$, —$N(CH_3)_2$, —$OCH_3$, —Cl, —$NO_2$ or —CN; $R^6$ represents —H, —OH, —$OCH_3$ or —$OC_2H_5$; X represents H, Cl, F or Br; n is an integer of 1 to 24; m is an integer of 0 to 5; h is an integer of 1 to 4; and $A^-$ represents $F^-$, $Cl^-$, $Br^-$, $I^-$, $BF_4^-$,

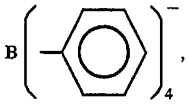

$PF_6^-$,

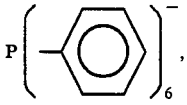

$ClO_4^-$, $SbF_6^-$, $SiF_6^-$, $(Mo_7O_7)^{6-}$, $(MoO_4)^{2-}$, $(Mo_7O_{24})^{2-}$, $(Mo_8O_{20})^{4-}$, $(SiMo_{12}O_{40})^{3-}$, $(PMo_{12}O_{40})^{3-}$, $(BMo_{12}O_{40})^{5-}$, $(OCr_2O_3 \cdot 12MoO_3)^{6-}$, $(H_2W_{12}O_{42})^{10-}$, $(WO_4)^{2-}$, $(H_2W_{12}O_{40})^{6-}$, $(PO_4W_{12}O_{36})^{3-}$, $(SiW_{12}O_{40})^{4-}$, $(FeW_{12}O_{40})^{5-}$, $NHO_2^-$, $C_pH_{2p+1}COO^-$,

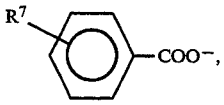

$CH_3SO_3^-$, $C_2H_5SO_3^-$,

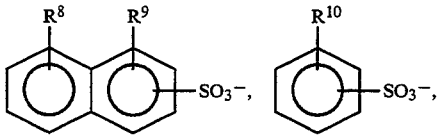

$CH_3SO_4^-$, $C_2H_5SO_4^-$, or $SO_4^{2-}$, in which $R^7$, $R^8$, $R^9$ and $R^{10}$ independently represent —H, —F —Cl, —$CH_3$, —OH, —$NH_2$ or —$NO_2$; and p is an integer of 0 to 24.

5. The image formation method as claimed in claim 1, wherein said quaternary ammonium salt has formula (III):

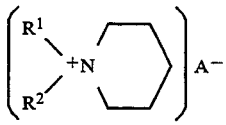

(III)

in which $R^1$ and $R^2$ independently represent H, —$C_nX_{2n+1}$,

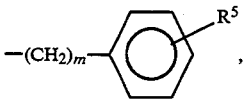

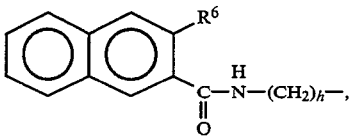

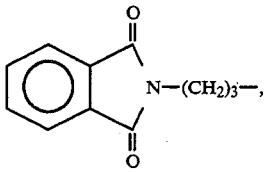

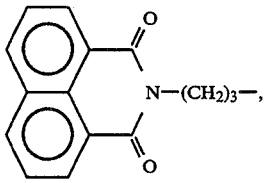

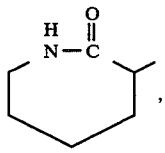

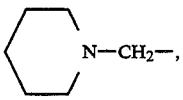

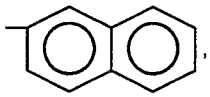

or

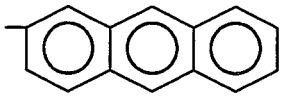

in which $R^5$ represents —H, —$CH_3$, —$NH_2$, —$N(CH_3)_2$, —$OCH_3$, —Cl, —$NO_2$ or —CN; $R^6$ represents —H, —OH, —$OCH_3$ or —$OC_2H_5$; X represents H, Cl, F or Br; n is an integer of 1 to 24; m is an integer of 0 to 5; h is an integer of 1 to 4; and A represents $F^-$, $Cl^-$, $Br^-$, $I^-$, $BF_4^-$,

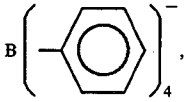

$PF_6^-$,

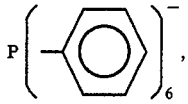

$ClO_4^-$, $SbF_6^-$, $SiF_6^-$, $(Mo_7O_7)^{6-}$, $(MoO_4)^{2-}$, $(Mo_7O_{24})^{2-}$, $(Mo_8O_{20})^{4-}$, $(SiMo_{12}O_{40})^{3-}$, $(PMo_{12}O_{40})^{3-}$, $(BMo_{12}O_{40})^{5-}$, $(OCr_2O_3 \cdot 12MoO_3)^{6-}$, $(H_2W_{12}O_{42})^{10-}$, $(WO_4)^{2-}$, $(H_2W_{12}O_{40})^{6-}$, $(PO_4W_{12}O_{36})^{3-}$, $(SiW_{12}O_{40})^{4-}$, $(FeW_{12}O_{40})^{5-}$, $HNO_2^-$, $C_pH_{2p+1}COO^-$,

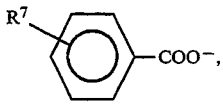

$CH_3SO_3^-$, $C_2H_5SO_3^-$,

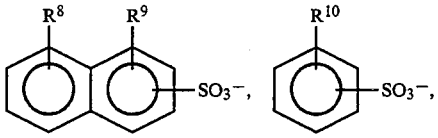

$CH_3SO_4^-$, $C_2H_5SO_4^-$, or $SO_4^{2-}$ in which $R^7$, $R^8$, $R^9$ and $R^{10}$ independently represent —H, —F, —Cl, —$CH_3$, —OH, —$NH_2$ or —$NO_2$; and p is an integer of 0 to 24.

6. The image formation method as claimed in claim 1, wherein said quaternary ammonium salt has formula (IV):

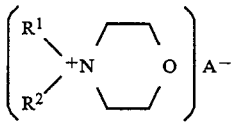

(IV)

in which $R^1$ and $R^2$ independently represent H, —$C_nX_{2n+1}$,

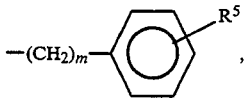

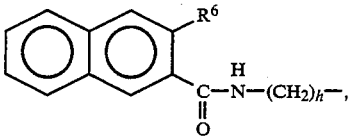

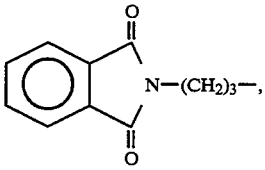

-continued

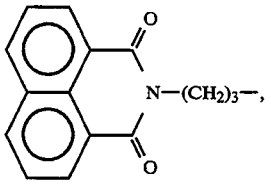

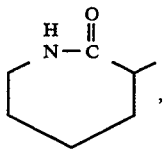

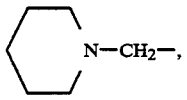

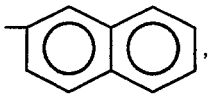

or

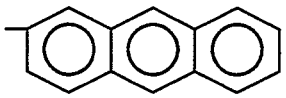

in which $R^5$ represents —H, $—CH_3$, $—NH_2$, $—N(CH_3)_2$, $—OCH_3$, —Cl, $—NO_2$ or —CN; $R^6$ represents —H, —OH, $—OCH_3$ or $—OC_2H_5$; X represents H, Cl, F or Br; n is an integer of 1 to 24; m is an integer of 0 to 5; h is an integer of 1 to 4; and $A^-$ represents $F^-$, $Cl^-$, $Br^-$, $I^-$, $BF_4^-$,

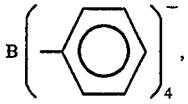

$PF_6^-$,

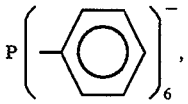

$ClO_4^-$, $SbF_6^-$, $SiF_6^-$, $(Mo_7O_7)^{6-}$, $(MoO_4)^{2-}$, $(Mo_7O_{24})^{2-}$, $(Mo_8O_{20})^{4-}$, $(SiMo_{12}O_{40})^{3-}$, $(PMo_{12}O_{40})^{3-}$, $(BMo_{12}O_{40})^{5-}$, $(OCr_2O_3 \cdot 12MoO_3)^{6-}$, $(H_2W_{12}O_{42})^{10-}$, $(WO_4)^{2-}$, $(H_2W_{12}O_{40})^{6-}$, $(PO_4W_{12}O_{36})^{3-}$, $(SiW_{12}O_{40})^{4-}$, $(FeW_{12}O_{40})^{5-}$, $HNO_2^-$, $C_pH_{2p+1}COO^-$,

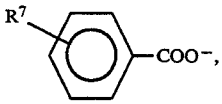

$CH_3SO_3^-$, $C_2H_5SO_3^-$,

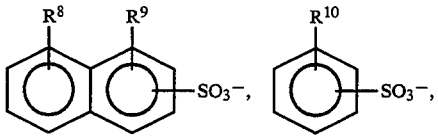

$CH_3SO_4^-$, $C_2H_5SO_4^-$, or $SO_4^{2-}$, in which $R^7$, $R^8$, $R^9$ and $R^{10}$ independently represent —H, —F, —Cl, $—CH_3$, —OH, $—NH_2$ or $—NO_2$; and p is an integer of 0 to 24.

7. The image formation method as claimed in claim 3, wherein said quaternary ammonium salt is selected from the group consisting of:

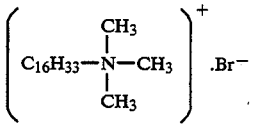

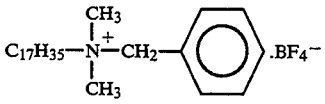

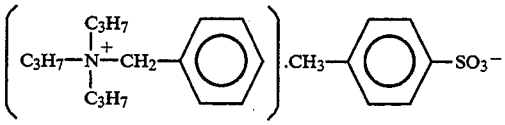

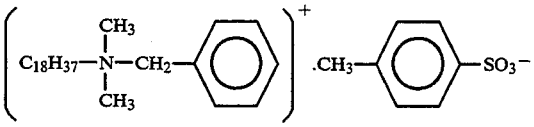

-continued

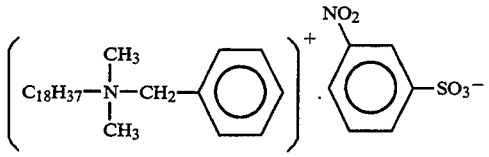

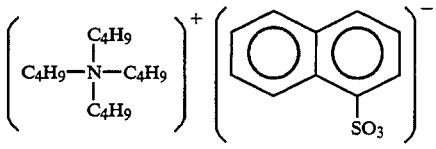

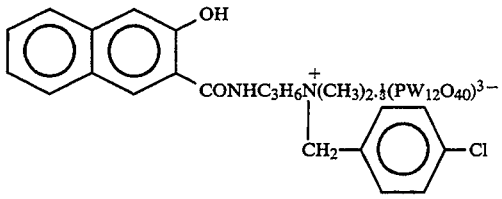

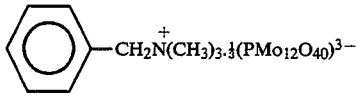

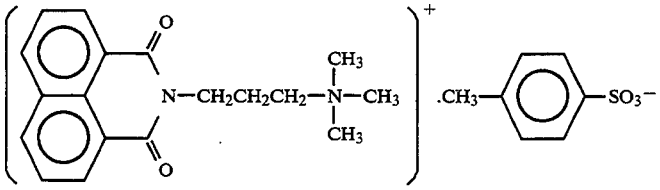

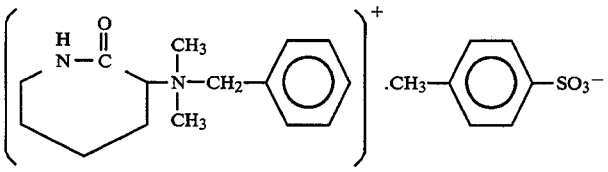

8. The image formation method as claimed in claim 1, wherein the amount ratio in terms of parts by weight of said quaternary ammonium salt to said binder resin is 0.1–10:100.

9. The image formation method as claimed in claim 1, wherein the amount ratio in terms of parts by weight of said coloring agent to said binder resin is 0.5–10:100.

10. The image formation method as claimed in claim 1, wherein said developer further comprises an auxiliary agent selected from the group consisting of a plasticizer, a resistivity-controlling agent, and a fluidity-improving agent.

11. The image formation method as claimed in claim 10, wherein said plasticizer is selected from the group consisting of dibutyl phthalate and dioctyl phthalate.

12. The image formation method as claimed in claim 10, wherein said resistivity-controlling agent is selected from the group consisting of tin oxide, zinc oxide and antimony oxide.

13. The image formation method as claimed in claim 10, wherein said fluidity-improving agent is selected from the group consisting of colloidal silica, titanium oxide and aluminum oxide in the form of finely-divided particles.

* * * * *